United States Patent [19]

Castro

[11] Patent Number: 4,666,203

[45] Date of Patent: May 19, 1987

[54] BAG CARRIER

[76] Inventor: Andres Castro, 4228 Mission St., San Francisco, Calif. 94112

[21] Appl. No.: 800,161

[22] Filed: Nov. 20, 1985

[51] Int. Cl.[4] ..... B65D 33/06

[52] U.S. Cl. ..... 294/170; 24/10 R; 294/137

[58] Field of Search ..... 294/82.17, 82.19, 137, 294/141, 148, 149, 153, 158, 165–167, 170; 24/10 R, 11 R, 11 C, 11 CC, 231, 236, 237, 241 R; 16/114 R; 40/334, 335; 220/94 R; 229/52 A, 52 AM; 383/6, 13, 15, 22, 23, 25, 26

[56] References Cited

U.S. PATENT DOCUMENTS

| | | | |
|---|---|---|---|
| 322,151 | 7/1885 | Beaumont | 294/146 |
| 763,104 | 6/1904 | Leuschner | 294/170 |
| 824,904 | 7/1906 | Cammett et al. | 294/166 |
| 850,705 | 4/1907 | Willis | 294/170 X |
| 945,602 | 1/1910 | Raschick | 24/10 R |
| 985,051 | 2/1911 | Moffitt | 24/11 C X |
| 1,137,548 | 4/1915 | Spurrier | 294/170 X |
| 1,165,406 | 12/1915 | Hauer | 24/236 |
| 1,637,860 | 8/1927 | Hill | 24/236 |
| 1,655,744 | 1/1928 | Swanby | 294/170 X |
| 2,466,939 | 4/1949 | Fowler | 24/237 |
| 2,778,555 | 1/1957 | Poryle | 294/146 |
| 3,727,830 | 4/1973 | Harrison | 383/26 |

FOREIGN PATENT DOCUMENTS

| | | | |
|---|---|---|---|
| 394220 | 4/1924 | Fed. Rep. of Germany | 294/170 |
| 473842 | 1/1915 | France | 294/170 |

*Primary Examiner*—Johnny D. Cherry

*Attorney, Agent, or Firm*—Donald A. Kettlestrings

[57] ABSTRACT

A bag carrier having a tubular handle and hooks attached to each end of the handle for supporting the handles of a bag to be carried. Flexible straps are provided in association with the hooks to selectively restrain the bag handles positioned on the hooks.

3 Claims, 10 Drawing Figures

BAG CARRIER

This invention relates to a bag carrier and more particularly to such a carrier for supporting and restraining the handles of bags so that transporting of the bags is made more convenient.

Many bag carrier constructions are known, but they have not proved entirely satisfactory. It is, therefore, an object of the present invention to provide a bag carrier of simple construction.

Another object is to provide a bag carrier which is easy to use.

A further object of the invention is the provision of a bag carrier which enables bag handles to be quickly and reliably positioned and restrained to permit easy and comfortable transport of the bag.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

To achieve these and other objects the present invention provides a bag carrier including a tubular handle defining first and second ends; first and second hooks attached, respectively, to the first and second ends; and first and second flexible straps, each strap defining first and second ends, the first ends of the straps attached, respectively, to the first and second ends of the handle, and each of the straps further defining an opening, each of the opening receiving a respective one of the hooks, whereby the straps act to restrain the handles of bags positioned on the hooks.

In accordance with one embodiment of the invention, each of the openings in the straps is located adjacent to the second end of each of the straps, and each of the straps is of a predetermined length to enable the openings and the second ends of the straps to be selectively removed from the hooks.

In another embodiment of the invention, each of the openings is located substantially mid-way between the first and second ends of each of the straps, and each of the straps is of predetermined length to prevent removal of the hooks from the openings.

In accordance with another embodiment of the invention, each of the straps, in addition to having an opening mid-way between the strap ends, defines a second opening adjacent the second end of each of the straps, and the predetermined length of each of the straps enables only the second openings and the second ends of the straps to be selectively removed from the hooks.

It is to be understood that both the foregoing general description and the following detailed description are exemplary and explanatory but are not restrictive of the invention.

The accompanying drawings, which are incorporated in and constitute a part of this specification, illustrate examples of preferred embodiments of the invention and, together with the description, serve to explain the principles of the invention.

Figure 1:
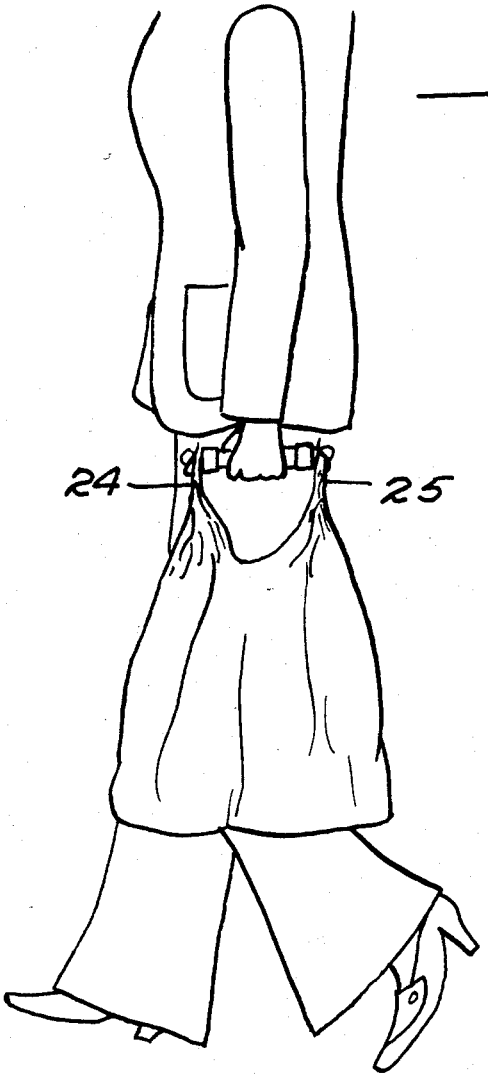
FIG. 1 is a view showing the bag carrier in use.

With reference now to the drawings, wherein like reference characters designate like or corresponding parts throughout the several views, there is shown in FIGS. 2–4 and 8–10 a bag carrier 10 in accordance with this invention. Carrier 10 comprises a tubular handle 12 defining first and second ends 14, 15. First and second hooks 16, 17 are attached, respectively, to ends 14, 15.

First and second flexible straps 18, 28 (FIGS. 2–4) and 38, 48 (FIGS. 8–10), each strap defining first and second ends 20, 30, 40 and 50, (FIGS. 2–4) and 60, 70, 80 and 90 (FIGS. 8–10), are attached at first ends 30, 50, 70 and 90 to ends 14, 15, respectively, of handle 12. Each of straps 18, 28, 38 and 48 further defines an opening 22, 32, 42 and 52, respectively, and each of openings 22, 32, 42 and 52 receives a respective one of hooks 17, 16' whereby straps 18, 28, 38 and 48 act to restrain handles 24, 25 of bags positioned on the hooks FIG. 1).

Figure 8:
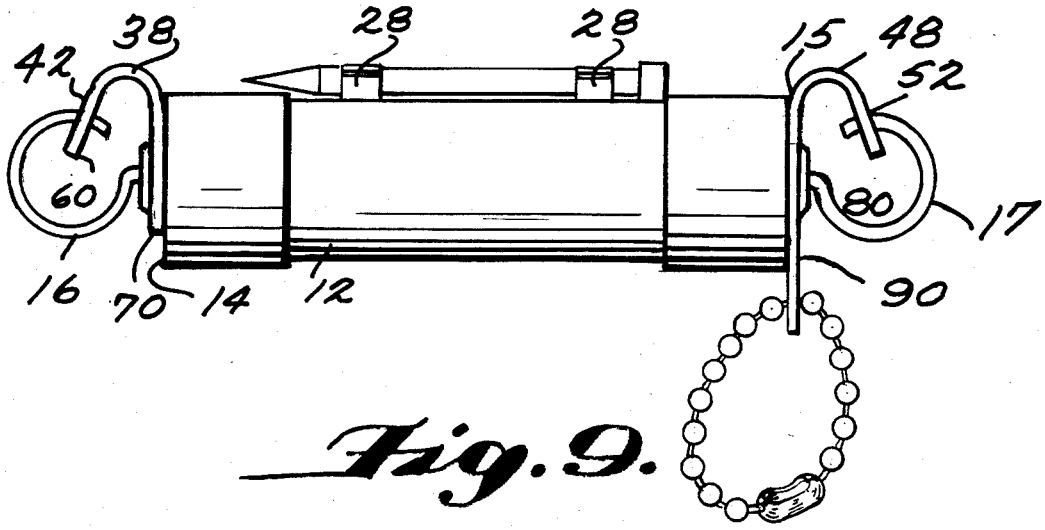
FIG. 8 is a side elevation view of another preferred embodiment of the bag carrier.
Figure 9:
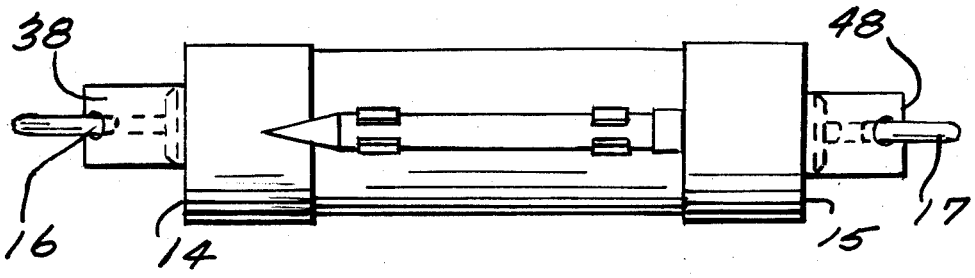
FIG. 9 is a top plan view of the bag carrier illustrated in FIG. 8.
Figure 10:
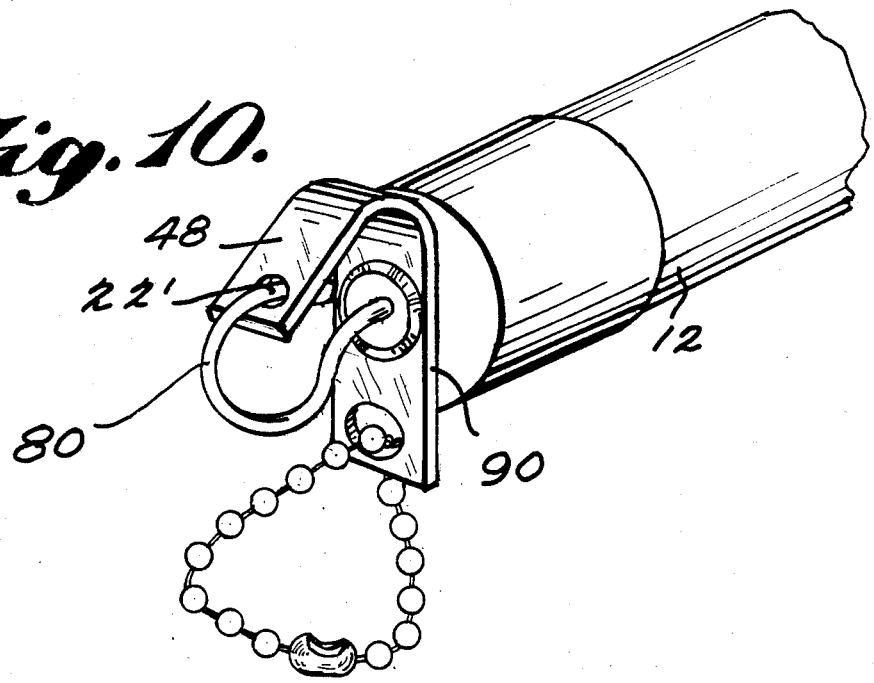
FIG. 10 is a fragmentary perspective view of the bag carrier illustrated in FIGS. 8 and 9.

In accordance with one embodiment of the invention, as illustrated in FIGS. 8–10, each opening 42, 52 is located adjacent to second end 60, 80 of each strap 38, 48, respectively, and each strap is of a predetermined length to enable openings 42, 52 to be selectively removed from hooks 16, 17.

Figure 4:
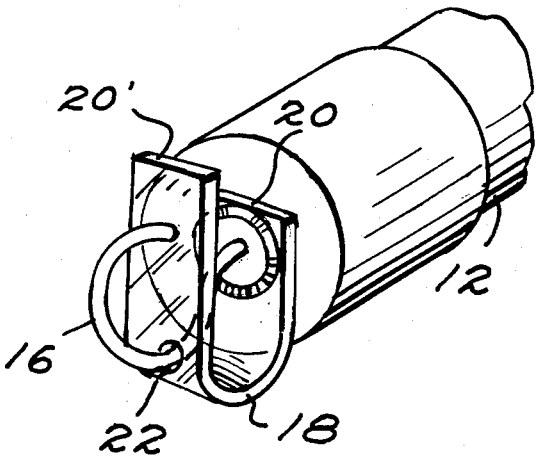
FIG. 4 is a fragmentary perspective view of the bag carrier illustrated in FIGS. 2 and 3.
Figure 2:
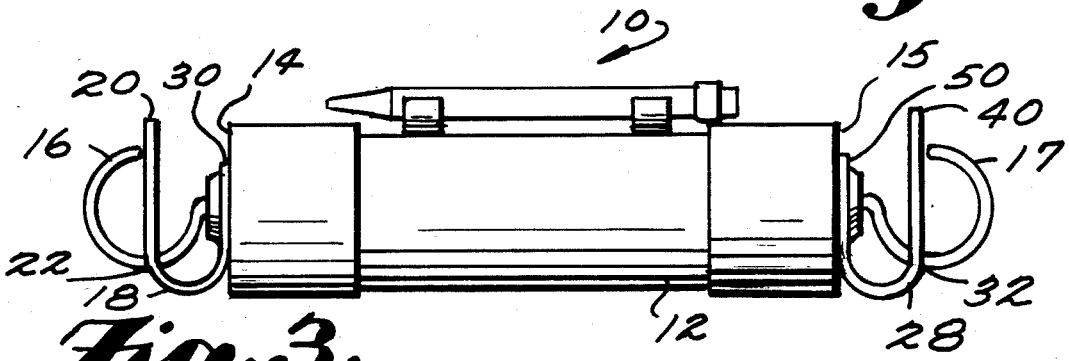
FIG. 2 is a side elevation view of one preferred embodiment of the bag carrier.
Figure 3:
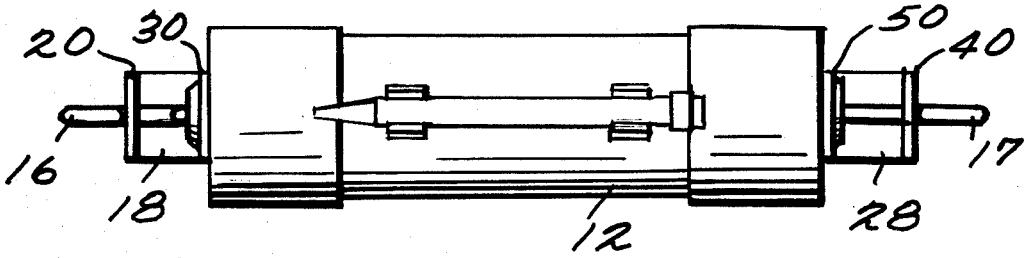
FIG. 3 is a top plan view of the bag carrier illustrated in FIG. 2.

In accordance with another preferred embodiment of the invention, as illustrated in FIGS. 2–4, each opening 22, 32 is located substantially mid-way between ends 20, 30 and 40, 50 of each strap 18, 28, respectively, and each of the straps is of a predetermined length to prevent removal of hooks 16, 17 from openings 22, 32.

Figure 5:
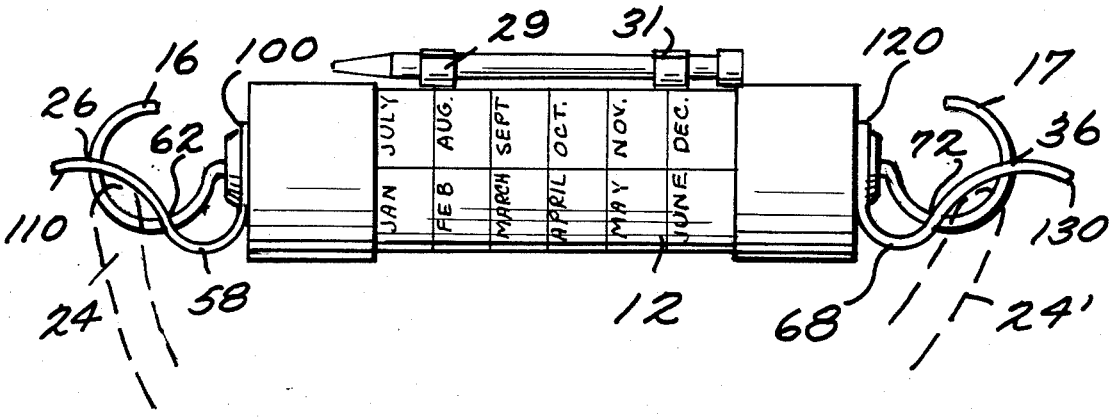
FIG. 5 is a side elevation view of another preferred embodiment of the bag carrier.
Figure 6:
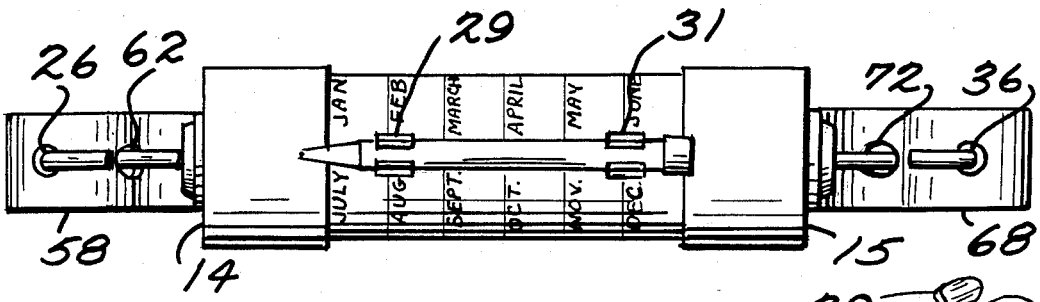
FIG. 6 is a top plan view of the bag carrier illustrated in FIG. 5.
Figure 7:
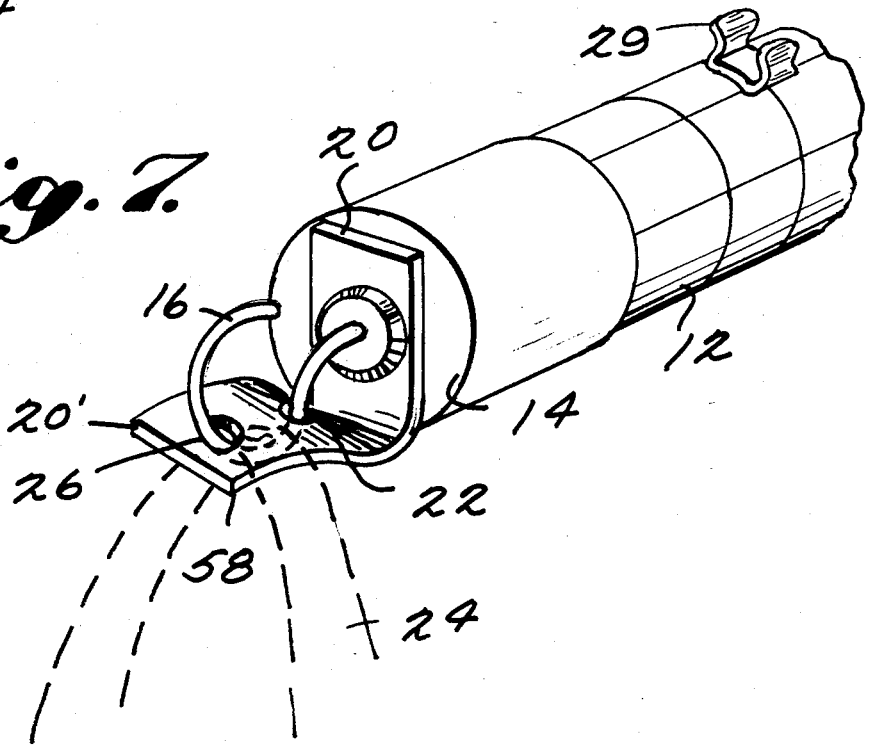
FIG. 7 is a fragmentary perspective view of the bag carrier illustrated in FIGS. 5 and 6.

A further embodiment of the invention is illustrated in FIGS. 5–7 wherein flexible straps 58, 68 each defines first and seconds ends 100, 110, and 120, 130, respectively. First ends 100, 120 are attached to ends 14, 15, respectively, of handle 12. Each of straps 58, 68 defines an opening 62, 72, respectively, and each of openings 62, 72 receives a respective one of hooks 16, 17. Each of straps 56, 68 further defines an additional second opening 26, 36, respectively, adjacent to end 110, 130 of each strap. In this embodiment, each strap 58, 68 is of a predetermined length to enable only second openings 26, 36 and second ends 110, 130 of each strap to be selectively removed from hooks 16, 17.

Each of the embodiments described herein may also include means 29, 31 attached to handle 12 for removably holding a pencil or pen.

In using the embodiment illustrated in FIGS. 8–10, second ends 60, 80 of each of straps 38, 48 are removed from hooks 16, 17, respectively, by moving each strap and each opening 42, 52 until second end 60, 80 of each of the straps is free of its respective hook. Bag handles 24, 25 (FIG. 1) are then positioned onto hooks 16, 17, respectively. Second end 60, 80 of each strap 38, 48 is then repositioned onto its respective hook 16, 17 by passing each hook through openings 42, 52 of each strap. This is best illustrated in FIG. 10. Bag handles 24, 25 are held in position on the hooks by means of straps 38, 48 until it is desired to remove the bag handles from the hooks. When removal of the bag handles from the hooks is desired, second ends 60, 80 of the straps are removed from the hooks to permit the bag handles also to be removed from the hooks.

Use of the embodiment illustrated in FIGS. 2–4 is accomplished by urging second end 20, 40 of each strap 18, 28 toward handle 12 so that second end 20, 40 of each strap is separated from the end of each hook 16, 17. This separation permits bag handles 24, 25 to be placed into position on hooks 16, 17, respectively. Second ends 20, 40 of each strap are then released, and the resilient characteristic of each strap causes second ends 20, 40 to return into contact with the ends of hooks 16, 17, respectively, so as to retain bag handles 24, 25 in position on the hooks. Removal of the bag handles from the hooks is simply accomplished by repeating the process and removing the bag handles from the hooks while second ends 20, 40 of each strap are separated from the ends of the hooks.

Use of the embodiment illustrated in FIGS. 5–7 is accomplished by first removing second ends 110, 130 of each strap from hooks 16, 17. This is accomplished by moving openings 62, 72 of the straps over hooks 16, 17, respectively, until second ends 110, 130 of the straps are free from the hooks. Bag handles 24, 25 are then positioned onto hooks 16, 17, respectively, and second ends 110, 130 of each strap are repositioned onto the hooks by reinserting the hooks through openings 26, 36 of each strap. Bag handles 24, 25 are thus retained on the hooks by straps 58, 68, and the bag handles are held in position beneath each strap and between openings 62 and 26 of strap 58 and between openings 72 and 36 of strap 68. Removal of the bag handles is quickly and simply accomplished by removing second ends 110, 130 of each strap from the hooks to permit removal of the bag handles from the hooks.

Hooks 16, 17 can also be used to support and restrain other than bag handles. For example, bus transfers can be impaled on the hooks and held in position on the hooks by means of the straps. This invention also contemplates the provision of a calendar on handle 12, and any other suitable indicia or information could be provided on the handle. Pencil holders 29, 31 may also be attached to handle 12.

The invention in its broader aspects is not limited to the specific details shown and described, and departures may be made from such details without departing from the principles of the invention and without sacrificing its chief advantages.

What is claimed is:

1. A bag carrier comprising:

a tubular handle defining first and second ends;

first and second hooks attached, respectively, to said first and second ends;

first and second flexible and resilient straps, each strap defining first and second ends, said first ends of said straps attached, respectively, to said first and second ends of said handle, and each of said straps further defining an opening, each said opening receiving a respective one of said hooks;

each said opening located substantially mid-way between said first and second ends of each said strap and wherein each said strap is of predetermined length to prevent removal of said hooks from said openings; and each of said straps further defining a second opening adjacent said second end of each said strap, each said second opening receiving a respective one of said hooks whereby said straps act to restrain handles of bags positioned on said hooks and wherein said predetermined length of each said strap enables said second openings and said second ends of said straps to be selectively removed from said hooks.

2. A bag carrier, as in claim 1, further including means attached to said handle for removably holding a pencil.

3. A bag carrier, as in claim 1, further including indicia on said handle designating the calendar year.

* * * * *